US007204459B2

(12) United States Patent
Thomas

(10) Patent No.: US 7,204,459 B2
(45) Date of Patent: Apr. 17, 2007

(54) KITE

(76) Inventor: Shawn Thomas, 744 E. 85th St., Brooklyn, NY (US) 11236

( * ) Notice: Subject to any disclaimer, the term of this patent is extended or adjusted under 35 U.S.C. 154(b) by 341 days.

(21) Appl. No.: 10/880,770

(22) Filed: Jun. 28, 2004

(65) Prior Publication Data

US 2006/0006278 A1 Jan. 12, 2006

(51) Int. Cl.
*A63H 27/08* (2006.01)

(52) U.S. Cl. ..... 244/153 R; 244/153 A

(58) Field of Classification Search ..... 244/153 R, 244/153 A, 155 A, 155 R
See application file for complete search history.

(56) References Cited

U.S. PATENT DOCUMENTS 2,476,801 A * 7/1949 Blazi ..... 244/153 R
2,483,614 A * 10/1949 Benson ..... 244/153 R
2,520,704 A * 8/1950 Wisney ..... 244/153 R
6,315,246 B1 * 11/2001 Wu et al. ..... 244/153 R
6,499,695 B1 * 12/2002 Talamo ..... 244/153 R
6,722,613 B1 * 4/2004 Phillips et al. ..... 244/153 R
2005/0224660 A1 * 10/2005 May et al. ..... 244/153 R

* cited by examiner

*Primary Examiner*—Michelle Clement
*Assistant Examiner*—Benjamin P. Lee
(74) *Attorney, Agent, or Firm*—Adams & Wilks

(57) ABSTRACT

A kite has a cover sheet having first and second opposed main surfaces. A frame assembly is attached to the second main surface of the cover sheet to define a body having an overall height and an overall width. The frame assembly has frame members connected together to form a generally conical-shaped sector portion defining an air passage through which air flows when the kite is in flight. A rotational vane is mounted on the frame assembly for undergoing rotation to regulate the flow of air flowing through the air passage when the kite is in flight.

15 Claims, 4 Drawing Sheets

KITE

BACKGROUND OF THE INVENTION

1. Field of the Invention

The present invention relates to kites and, more specifically, to a kite which has sufficient lift and stability for superior flight characteristics at high altitudes.

2. Background Information

Flying a kite is a well-known and entertaining activity. Kites are generally constructed of a frame formed of interconnected, thin wood strips which are joined at their ends to the edges of a flexible cover sheet. A line or string is attached to the frame to enable the user to control the kite in flight. A tail is also attached to the kite to improve its stability.

A typical kite frame is formed of two frame members or struts which are disposed perpendicular to each other about a connecting cross point. Other frames utilize two diagonally overlapped struts and a third, central cross strut. The cover sheets have shapes coinciding with the boundary of the peripheral ends of the struts. Such cover sheets have diamond and other multi-sided shapes.

However, the foregoing conventional kites do not have sufficient lift and stability for suitable flight characteristics, particularly at high altitudes. More specifically, the conventional kites tend to roll to an undesirable degree when flown at high altitudes and are not stable under most meteorological conditions. Furthermore, the conventional kites are rather difficult to assemble.

SUMMARY OF THE INVENTION

It is an object of the present invention to provide a kite having sufficient lift and stability for superior flight characteristics at high altitudes.

It is another object of the present invention to provide a kite which is easy to fly and is controllable and stable in flight.

It is another object of the present invention to provide a kite having a structure which is strong, lightweight, easy to assemble, and inexpensive to manufacture.

It is still another object of the present invention to provide a kite with reduced roll characteristics and which flies with high stability under most meteorological conditions.

It is another object of the present invention to provide a kite having a novel aerodynamic surface defining a conical-shaped sector portion and a rotational vane which results in more stable flight characteristics and increased lift.

It is yet another object of the present invention to provide a kite which provides striking visual effects and maximizes the presentation of ornamental designs on one or more surfaces of the kite.

It is yet another object of the present invention to provide a kite which is cost effective yet operationally efficient.

The foregoing and other objects of the present invention are carried out by a kite comprised of a cover sheet having first and second opposed main surfaces. A frame assembly is attached to the second main surface of the cover sheet to define a body having an overall height and an overall width. The frame assembly has frame members connected together to form a generally conical-shaped sector portion having an air passage through which air flows when the kite is in flight. A rotational vane is mounted on the frame assembly for undergoing rotation to regulate the flow of air flowing through the air passage when the kite is in flight.

The frame members preferably comprise a first frame member, a second frame member, a third frame member, a fourth frame member, and a fifth frame member. Each of the first, second and third frame members has first and second opposed end portions. The first and second frame members are overlapped at a connecting point with the corresponding first ends being spaced at a first predetermined distance apart and with the corresponding second end portions being spaced at a second predetermined distance apart. The third frame member overlaps the first and second frame members at the connecting point and extends outward from the connecting point so that the first end portion of the third frame member is disposed between the second end portion of the first frame member and the first end portion of the second frame member and so that the second end portion of the third frame member is disposed between the first end portion of the first frame member and the second end portion of the second frame member.

The fourth frame member has a first end portion connected to the first, second and third frame members at the connecting point and a second end portion. The fifth frame member has a first end portion connected to the first end portion of the first frame member and a second end portion connected to the first end portion of the second frame member. The second end portion of the fourth frame member is connected to a generally central portion of the fifth frame member. The fifth frame member has a generally curved peripheral edge portion defining a curved peripheral edge of the conical-shaped sector portion of the frame assembly.

The kite also preferably has a flexible line, a flexible tail, and a cord frame. The flexible line is connected to the connecting point of the first, second, and third frame members and extends through the cover sheet and outward from the first main surface of the cover sheet. The flexible tail is connected to and extends away from the cover sheet. The cord frame connects the first, second, third, fourth and fifth frame members together to form the frame assembly.

BRIEF DESCRIPTION OF THE DRAWINGS

The foregoing summary, as well as the following detailed description of preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown. In the drawings.

DETAILED DESCRIPTION OF THE PREFERRED EMBODIMENTS

While this invention is susceptible of embodiments in many different forms, this specification and the accompanying drawings disclose only certain examples of the use of the invention. The invention is not intended to be limited to the embodiments so described, and the scope of the invention will be pointed out in the appended claims.

In the following description of the preferred embodiments of the present invention, the term "about" is used to quantify the preferred dimensions of the kite and its components. The term "about" is defined to cover the specific dimensions described as well as values within a range of ±25% of the specific dimensions described.

Throughout the following description and drawings, an identical reference number is used to refer to the same component shown in multiple figures of the drawings.

Figure 2:
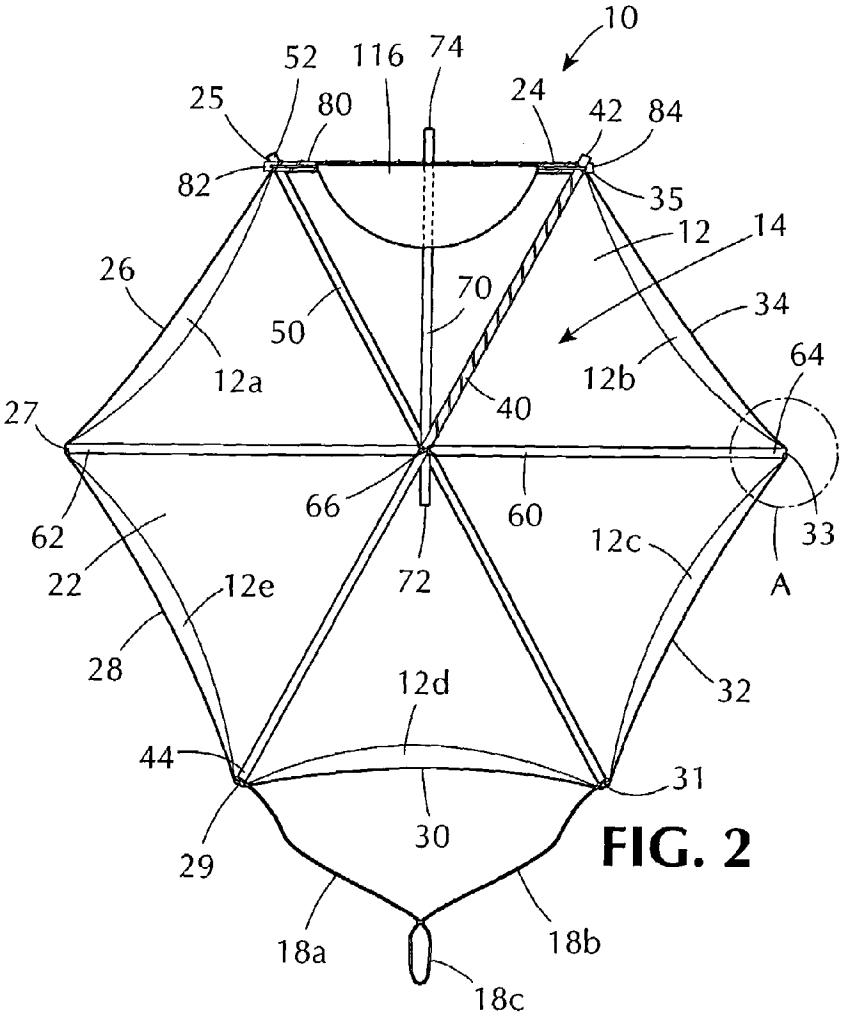
FIG. 2 is a rear elevational view of the kite according to the present invention.
Figure 1:
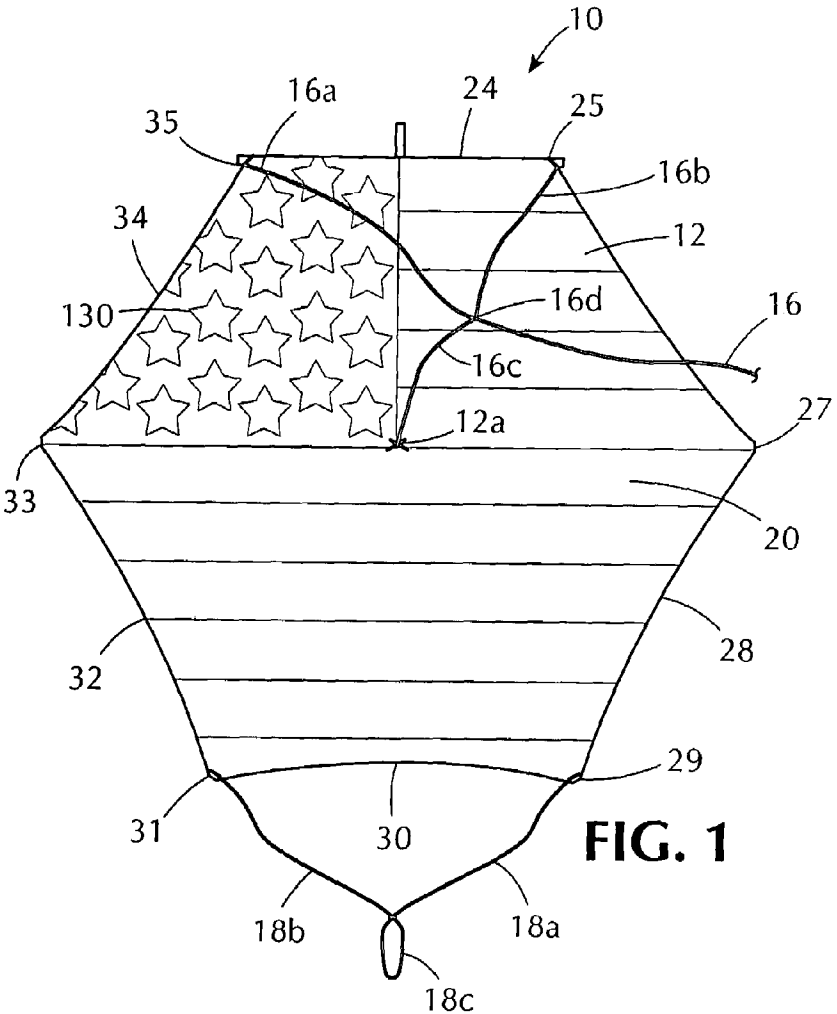
FIG. 1 is a front elevational view of a kite according to an embodiment of the present invention.

Referring now to the drawings in detail, wherein like numerals are used to indicate like elements throughout, there is shown in FIGS. 1–6 an embodiment of a kite, generally designated at 10, according to the present invention. As shown in FIGS. 1 and 2, the kite 10 includes a membrane or cover sheet 12, a frame assembly denoted in general by reference number 14, a control line 16, and an elongated, flexible tail 18. The cover sheet 12 is formed of a single piece of flexible material, such as heavy paper, cardboard or light, thin paper or plastic and, in this embodiment, has a six-pointed or general star shape. The cover sheet 12 has first and second main, opposed surfaces 20 and 22, respectively. The overall shape of the cover sheet 12 corresponds to the shape of the frame assembly 14 as described hereafter. In the embodiment illustrated in FIGS. 1 and 2, the cover sheet 12 is provided with six (6) contiguous, peripheral edges 24, 26, 28, 30, 32 and 34. The peripheral edges are separated by apexes 25, 27, 29, 31, 33 and 35. In a preferred embodiment, the peripheral edges 24, 26, 28, 30, 32 and 34 have a substantially curved form between the respective apexes 25, 27, 29, 31, 33 and 35.

The frame assembly 14 is formed of first, second, third, fourth and fifth frame members or struts 40, 50, 60, 70 and 80, respectively. Each of the first, second and third struts 40, 50 and 60 has first and second opposed end portions, such as the first and second end portions 42 and 44, respectively, of the first strut 40, the first and second end portions 52 and 54, respectively, of the second strut 50, the first and second end portions 62 and 64, respectively, of the third or cross strut 60, the first and second end portions 72 and 74, respectively, of the fourth strut 70, and the first and second end portions 82 and 84, respectively, of the fifth strut 80. Each of the first, second, third, fourth and fifth struts 40–80 is preferably formed of a thin, lightweight, substantially rigid material. Although lightweight wood, such a bamboo or balsa wood, is utilized in a preferred embodiment of the present invention, the struts 40–80 may be formed of any other suitable lightweight material including, for example, a plastic having the characteristics described above. It is understood by those of ordinary skill in the art that a plastic frame could be injected molded to form all five struts in one piece in the shape shown in the drawings and further described below to provide the finished product.

Figure 7:
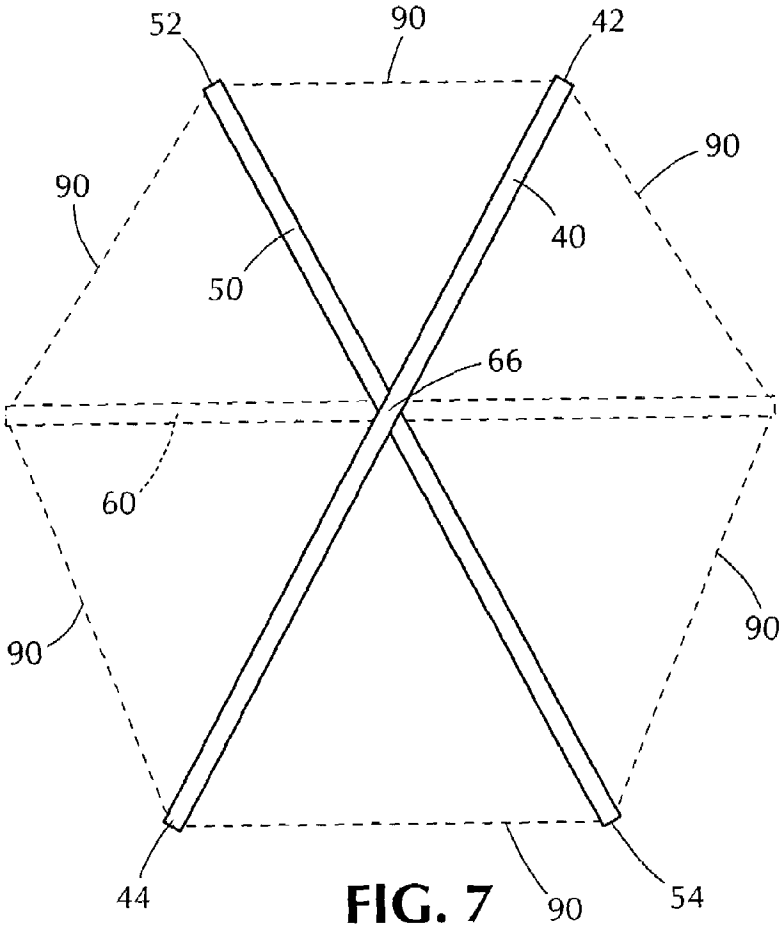
FIG. 7 is a rear elevational view of the kite showing the upright struts overlapped at a connecting point located off center from the center point of each of the upright struts.
Figure 6:
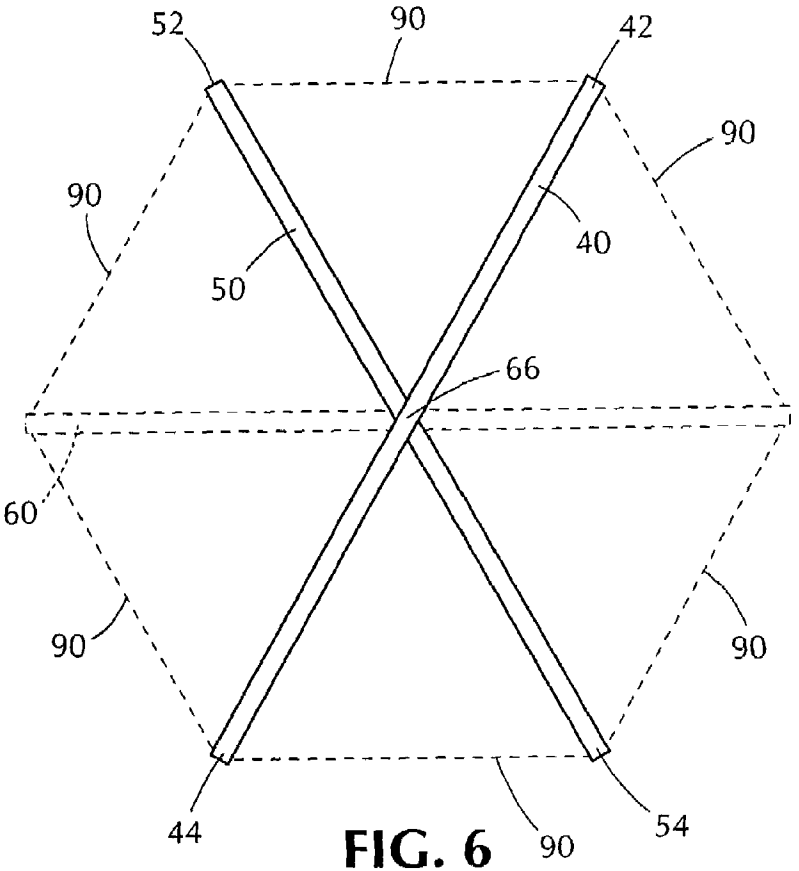
FIG. 6 is a rear elevational view of the kite showing the upright struts overlapped at a connecting point located at the center point of each of the upright struts.

Referring to FIGS. 2, 6 and 7, the first and second struts 40 and 50 are disposed in an overlapping, diagonal orientation creating a substantially X shape. The first and second struts 40 and 50 are overlapped at an intersecting or connecting point denoted by reference number 66, with the first strut 40 disposed above the second strut 50. Preferably, as shown in FIG. 6, the connecting point 66 is located at a point corresponding to the center point of each of the first and second struts 40 and 50. Alternatively, as shown in FIG. 7, the connecting point 66 is located off-center from the center point of each of the first and second struts 40 and 50 such that the spacing between the corresponding first ends 42 and 52 of the first and second struts 40 and 50 is less than the spacing between the corresponding second ends 44 and 54 of the first and second struts 40 and 50, respectively. The third strut 60 extends between both of the first and second struts 40 and 50 at the connecting point 66. The first end portion 72 of the fourth strut 70 is connected to the first, second and third struts 40–60 at the connecting point 66 and the second end portion 74 of the fourth strut 70 is connected to the fifth strut 80. The first end portion 82 and the second end portion 84 of the fifth strut 80 are connected to the second end portions 52, 42 of the second and first struts 50, 40, respectively. The first, second, third and fourth struts 40, 50, 60 and 70 are connected together at the connecting point 66 by suitable means, such as by an adhesive, a string, a screw or a nail. The first and second ends 62 and 64, respectively, of the third strut 60 extend outward from the connecting point 66 and are disposed between the first and second ends of the first and second struts 40 and 50 as shown in FIG. 2.

Figure 4:
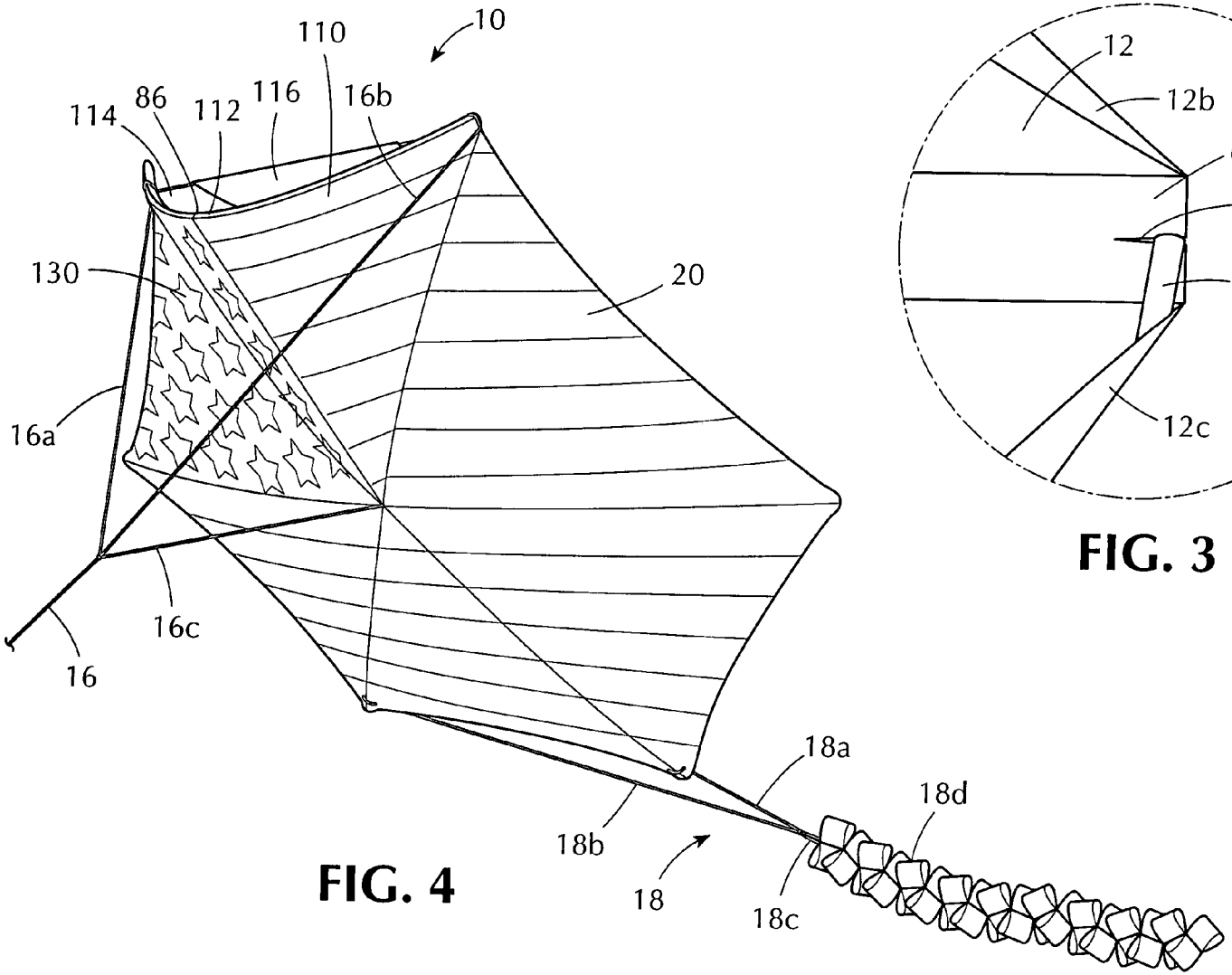
FIG. 4 shows the kite according to the present invention as viewed in flight from below.
Figure 5:
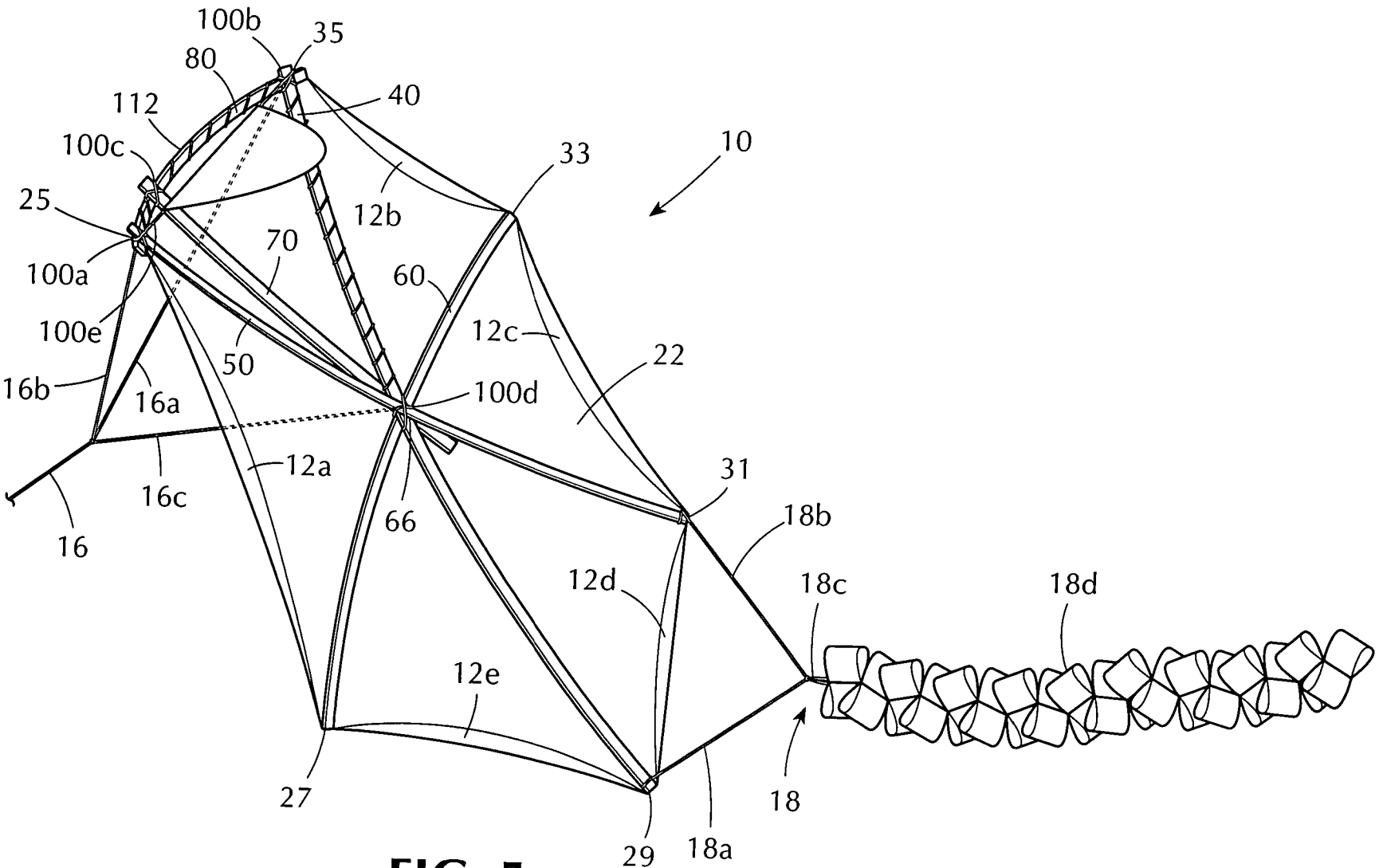
FIG. 5 shows the kite according to the present invention as viewed in flight from above.

The first, second, third and fourth struts 40–70, including the corresponding first and second ends thereof, are joined to the second main surface 22 of the cover sheet 12. Preferably, an adhesive, such as hot mill glue, is employed to join the struts 40, 50, 60 and 70 to the cover sheet 12. Due to the overlapping relationship between the struts 40–60 and the tension created by a cord 100 as further described below, each of the struts 40–60 has a slight bow formed therein, as shown in FIGS. 4 and 5, defined by a slight bend between the respective first and second ends thereof. The bends in the struts 40–60 form a slight bow in the cover sheet 12 when the frame assembly 14 is attached to the cover sheet 12. It should be noted that adhesive may be applied to selective parts of the connecting surface portion or to substantially the entire connecting surface portion of the struts 40–60 for bonding to the cover sheet 12.

Referring to FIGS. 4 and 5, the fifth strut 80 is curved in the general shape of sector of a circle. The first end portion 82 and the second end portion 84 of the fifth strut 80 are connected to the first end portion 52 of the strut 50 and the first end portion 42 of the strut 40, respectively. The second end portion 74 of the fourth strut 70 is connected to a generally central portion 86 of the fifth strut 80. As further described below, the fifth strut 80 is held in the curved configuration by the cord 100 interconnecting the first ends of the struts 40, 50 and 80 and interconnecting the second end 74 of the strut 70 to the central portion 86 of the strut 80. When the cover sheet 12 is connected to the frame assembly 14 as described above, the struts 40, 50, 70 and 80 and the portion of the cover sheet 12 connected thereto form a generally conical-shaped sector 111 having a curved peripheral edge 112. The conical-shaped sector portion 110 defines a slot or gap 114 which functions as an air passage through which air passes or flows when the kite is in flight. A rotational vane 116 is suspended over the curved edge 112 of the conical-shaped sector portion 110 for undergoing rotational or turning movement during flight of the kite. As further described below, the conical-shaped sector portion 110 and the rotational vane 116 define a flight stabilization device or stabilization means for stabilizing the kite 10 during flight.

Figure 3:
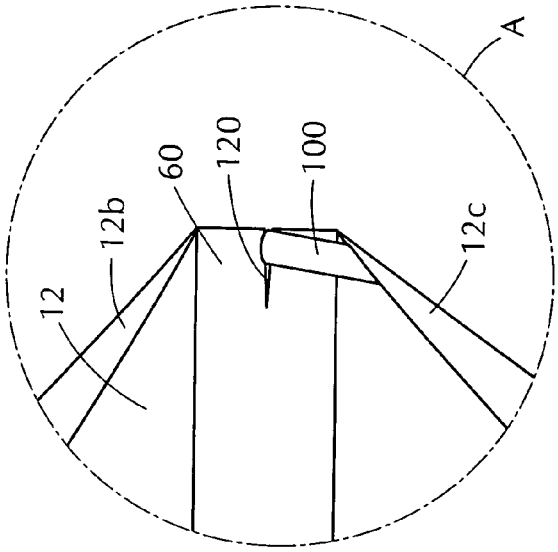
FIG. 3 is an enlarged fragmentary view of a portion A of the kite in FIG. 2 showing the connection between one of the struts, the cover sheet and the cord.

The kite 10 is provided with a cord frame 90 which is shown in dashed line in FIGS. 6 and 7 and portions of which are shown in other figures. The cord frame 90 is preferably a single length of heavy thread or string which, together with the frame assembly 14, define the general shape of the kite 10. FIG. 3 is an enlarged fragmentary view of a portion A of the kite in FIG. 2 showing the connection of the strut 60, the cover sheet 12 and the cord 100 at the apex 33. Although not shown in detail, the apexes 27, 29 and 31 have the same construction as the apex 33. Each of the first and second ends 62, 64 of the strut 60 and each of the second ends 44, 54 of the struts 40 and 50, respectively is provided with a transverse notch 120 for the reception of the string 100. At each of the apexes 25 and 35, the corresponding end portions of the struts 40, 50 and 80 are secured by means of loops of strings 100*a*, 100*b* forming part of the string 100. Similarly, the second end 74 of the strut 70 is secured to the central portion of the strut 70 by means of a loop of strings 100*c* which also forms part of the string 100.

Another important feature of the invention resides in the formation of the cord frame 90 using the single piece of string 100 for holding the frame assembly 14 securely in its assembled condition and for providing a string extension portion 100*e* for rotationally supporting the vane 116 as described below.

The struts 40 and 50 are first positioned to form an X-shape as shown in either of the embodiments of FIGS. 6 and 7 to define the connecting point 66. Thereafter, with reference to FIGS. 4 and 5, starting at the connecting point 66, a loop 100*d* of the string 100 wraps around portions of the struts 40–60 and the first end portion 72 of the strut 70 to connect them together. The string 100 then wraps around a portion of the strut 40 moving upwardly to the apex 35 where it is formed into the loop 100*b* to connect the first end 42 of the strut 40 and the second end 84 of the strut 80 together. The string 100 then extends across to the apex 33 where it extends into the notch 120 at the second end 64 of the strut 60. From the apex 33, the string 100 then extends to the apex 31 where it extends into the notch 120 at the second end 54 of the strut 50. From the apex 31, the string 100 then extends to the apex 29 where it extends into the notch 120 at the second end of the strut 40. From the apex 29, the string 100 extends to the apex 27 where it extends into the notch 120 at the first end of the strut 60. From the apex 27, the string 100 extends to the apex 25 where it is formed into the loop 100*a* to connect the first end 52 of the strut 50 and the first end 84 of the strut 80 together. From the apex 25, the string 100 wraps around a portion of the strut 80 across to the point of intersection between the central portion of the strut 80 and the second end portion of the strut 70 where the loop 100*c* is formed to connect the struts 70, 80 together. From this point of intersection, the string 100 continues to wrap around the strut 70 until it returns again to the apex 35. Finally, from the apex 35, the string 100 extends directly across to the apex 25 and is securely tied thereto to complete the cord frame and to provide a string extension portion 100*e* disposed generally directly below the curved edge 112 of the conical-shaped sector portion 110.

Although in the foregoing embodiment the string 100 is formed of a single piece of string, it is understood by those skilled in the art that the string 100 may be formed of several pieces of strings which are suitably connected together to form the cord frame 90 as described above. Furthermore, the string extension portion 100*e* for supporting the vane 116 may be constituted of a separate piece of string whose opposite ends are secured to respective apexes 25, 35 of the frame assembly before or after the cord frame 90 is formed.

As best shown in FIGS. 2–4, the cover sheet 12 is provided with marginal flaps 12*a*–12*e* which are folded around the cord frame 90 and glued or otherwise fastened to the main surface 22 of the cover sheet 12. Preselected portions of the struts 40–80 are also secured to the main surface 22 of the cover sheet 12, using an adhesive or other suitable connecting means, to further securely mount the cover member to the frame assembly 14. By this construction, the kite 10 is subject to less tearing and disintegration during handling by a user prior to and/or during flight.

The vane 116 is mounted on the string extension portion 100*e* of the string 100 for undergoing rotational or turning movement relative to the cover sheet 12 and frame assembly 14. The string extension portion 100*e*, which extends along a diametrical line of the vane 116, defines a rotational axis of the vane 116. In this embodiment, the vane 116 is a generally semicircular-shaped member and has a radius which permits the vane 116 to undergo free rotational movement relative to the cover sheet 12 and frame assembly 14 about its rotational axis. Stated otherwise, the vane 116 is permitted to undergo rotational movement about its rotational axis without contacting the cover sheet 12 or the frame assembly 14. In the present embodiment, the vane 116 comprises a circular piece of material, such as heavy paper, cardboard or light, thin paper or plastic, which is folded in half to form the semicircular shape of the vane 116. In the folded state, the two halves of the circular piece of material are secured together by suitable connecting means, such as an adhesive or bonding tape. Prior to securing the two halves of the circular piece of material together, the vane 116 is mounted on the string extension portion 100*e* of the string 100 such that the string extension portion 100*e* extends along the diametrical line of the vane 116 as shown in FIGS. 2, 4 and 5. It is understood that other forms of connection are suitable for securing the vane 116 to the string extension portion 100*e* so long as the vane 116 is permitted to rotate freely relative to the cover sheet 12 and the frame assembly 14 without contacting them.

It will be appreciated by those of ordinary skill in the art that the conical-shaped sector portion 110 forming the slot 114 and the rotational vane 116 define a flight stabilization device or stabilization means for stabilizing the kite 10 as the kite is pulled into the wind. More specifically, when the kite 10 is drawn through the air against the wind in the in-flight configuration shown in FIG. 4, the slot 114 of the conical-shaped sector portion 110 permits a current of air to flow along the main surface 22 of the kite 10. At the same time, the vane 116 will be rotated or turned due to the wind pressure thereagainst. Rotation of the vane 116 regulates the airflow passing through the slot 114 of the conical-shaped sector portion 110, thereby creating a stabilizing effect on the front end of the kite to stabilize the kite into the wind. Thus the flight stabilization device enables the kite 10 to fly with reduced roll characteristics and with high stability under most meteorological conditions.

It will be appreciated by those of ordinary skill in the art that without the slot 114 and the vane 116, air currents striking the main surface 20 of the kite 10 are primarily divided and deflected in opposite directions of the body of the kite 10. It is a well-known aerodynamic phenomena that air currents dividing and deflected in opposite directions result in a vacuum or low pressure point in the area where the air currents separate. Undoubtedly, this low pressure area results in eddy currents which tend to destabilize the kite 10. If the direction or velocity of the air changes, or if the angle or relative movement of the kite changes with respect to the air currents, this vacuum or low pressure area will shift relative to the main surface 20 of the kite 10. This causes the kite to be tossed or heaved due to the change of this low pressure area relative to the main surface 20 of the kite. By providing the conical-shaped sector portion 110 and the vane 116 across the slot 114 of the conical-shaped sector portion 110, this low pressure area is substantially eliminated, thereby stabilizing the kite 10.

Referring again to FIGS. 1, 4 and 5, the control line 16 of the kite 10 enables a user to control the height and direction of flight of the kite 10. In a preferred embodiment, the control line 16 is formed of a thin, lightweight string, preferably comprised of a nylon monofilament line. The string is wound around a conventional reel or holder (not shown) at one end and can be unwound to any length to control the height of the kite 10 while in use. The opposite end of the control line 16 has a first line segment 16*a* connected to the apex 35, a second line segment 16*b* connected to the apex 25, and a third line segment 16*c* connected to the connecting point 66. The first, second and third line segments 16*a*–16*c* are joined at a single union 16*d* to provide a large triangular connection to stabilize the kite 10 during flight. At each connection point, the first, second and third line segments 16*a*–16*c* are securely tied to the respective strut members intersecting at the connection point to securely attach the control line 16 to the frame assembly 14. An aperture 12*a* is formed in the cover sheet 12 approximate the connecting point 66 of the frame assembly 14. The aperture 82 extends through the cover sheet 12 and provides a passage for the line segment 16*c* such that the line segment 16*c* extends outward from the first main surface 20 of the cover sheet 12 as shown in FIGS. 1 and 4.

In a preferred embodiment, the control line 16 is comprised of a nylon monofilament line having at least 20-pound strength, such as those commonly used in fishing. The elastic properties of nylon make it best suited for use in winds of varying intensity. The line segments 16*a*, 16*b* have the same length, and the line segment 16*c* has a smaller length than the line segments 16*a*, 16*b*. This relationship in the length of the line segments 16*a*–16*c* provides further stability for the kite 10 during flight. It is understood that the overall length of the control line 16 is not critical and that a control line having a length between 75 feet and 1500 feet may be used. It has been found that control lines having a 20-pound strength are best suited for use when the wind is between 7–15 miles per hour, that lines having a 25-pound strength are best in winds between 12–25 miles per hour, and that lines having 30-pound strength are best in winds between 24–45 miles per hour.

The tail 18 is provided with a tail hanger comprised of a thin, lightweight string having a first line portion 18*a* and a second line portion 18*b* connected at one end to form a loop portion 18*c*. Opposite ends of the first and second line portions 18*a*, 18*b* are connected to the intersecting struts at respective apexes 29, 31. An elongate extension 18*d* is secured to the loop portion 18*c* for providing stability to the kite 10 during flight. The extension 18*d* may be formed of any thin, flexible material, such as a thin, flexible fabric or ribbon. It has been found that use of a flexible ribbon provides the best flying performance for the kite. Preferably, the extension 18*d* of the tail 18 has a length of approximately 10 feet which is suitable for high wind conditions.

In a preferred embodiment, the frame assembly 14 has a predetermined size (e.g., length and width) sufficient to enable the kite 10 to be easily transported and yet have adequate lift for flight. Preferably, the first and second struts 40 and 50 have a length of about 24 inches, a width of about ⅓ inch and a thickness of about ⅓ inch. The third or cross strut 60 has a length of about 20 inches, a width of about ⅓ inch and a thickness of about ⅓ inch. The first and second ends of each of the first, second and third struts 40, 50 and 60, respectively, are disposed adjacent to one of the apexes 25, 27, 29, 31, 33 and 35 in the cover sheet 12. As noted above, the peripheral edges of the cover sheet 12 form a generally curved line between each pair of apexes so as to result in the six (6) sided figure shown in FIGS. 1–7. The kite 10 (i.e., excluding the control line 16 and the tail 18) thus has a preferred overall length or height in the range of about 22 to 26 inches, and more preferably about 24 inches, and a preferred overall width in the range of about 18 to 22 inches, and more preferably about 20 inches. Preferably, the kite 10 of the present invention has a surface area (approximated as height×width) of the cover sheet 12 in the range of about 396 to 572 square inches, and more preferably about 480 square inches. The length of the extension 18*d* of the tail 18 may vary between about 15 feet to about 30 feet depending on wind conditions, where the longer tail has been found to be more suitable for higher wind conditions. By the foregoing construction and preferred dimensions, the kite 10 of the present invention has been found to be capable of flying in winds ranging from 7 m.p.h. to 65 m.p.h. with high stability and superior flight performance.

It will be appreciated by those of ordinary skill in the art that the dimensions for the kite of the present invention are not limited to the foregoing preferred dimensions. For example, the length and width of the kite, excluding the control line and the tail, may be larger or smaller (e.g., for miniature size kites) than the foregoing preferred lengths and widths depending, for example, on the particular use for the kite, such as for competition or advertising purposes. The lengths of the control line and the tail are appropriately selected to conform to the dimensions for the frame and the cover selected for the kite in order to insure stability of the kite in flight.

In use, after the control line 16 has been secured to the frame assembly 14 as described above and shown in FIGS. 1, 4 and 5, the control line 16 is unwound from the reel or holder to a suitable length to set the height of the kite 10 above the ground. The kite 10 may then be flown in the orientation shown in FIG. 4 in which the first main surface 20 of the cover sheet 12 is disposed at an angle facing the oncoming wind.

In the embodiment of the kite 10 described herein, the first end portion 72 of the strut 70 extends downwardly from the connecting point 66 and the second end portion 74 of the strut 70 extends upwardly from the loop 100*c* connecting the struts 70 and 80 together. The extension of the first end portion 72 from the connecting point 66 facilitates connection of the strut 70 to the struts 40–60 at the connecting point, as shown in FIGS. 2 and 5, particularly when the loop 100*d* of the string 100 is used to connect the struts 40–70 together at the connecting point as described above. Likewise, the extension of the second end portion 74 from the loop 100*c* facilitates connection of the strut 70 to the strut 80, as shown in FIG. 5. The extension of the second end portion 74 of the strut 70 also provides a means for holding and handling the kite during transportation thereof or in preparation for flying the kite. This additional function of the second end portion 74 of the kite avoids the necessity of having to hold or handle the kite 10 by contacting other portions of the kite which may lead to damage of the cover sheet 12, the frame assembly 14, and/or the cord frame 90. It is understood by those of ordinary skill in the art, however, that the first and second end portions 72, 74 of the strut 70 may terminate at and need not extend from the connecting point 66 and the loop 100*c*, respectively.

It will be appreciated by those of ordinary skill in the art that kite 10 may readily be sold in kit form. A kit for producing the kite 10 includes the five struts 40–80, the cover sheet 12, the string 100 for the cord frame 90, the vane 116, the control line 16, and the tail 18. The kite 10 can be readily assembled as described above and shown in the drawings. The unique structural design of the kite provides for the simplicity of its structure, and this novel feature results in both ease and simplicity of construction and reduced manufacturing costs.

It will also be appreciated that the kite 10 of the present invention is suitable for use as an advertising or display device. For example, as shown in FIGS. 1 and 4, the main surface 20 of the kite can be imprinted or embroidered with a design representative of the flag of the United States of America which is suitable when flying the kite 10 during national holidays, such as Memorial Day, Labor Day and Independence Day. Alternatively, other decorative designs or advertising indicia, such as a company name or logo or an advertising message, may be applied to one or both of the main surfaces 20, 22 of the kite 10 by using, for example, a printing or an embroidering process. Furthermore, instead of imprinting or embroiding indicia, one or more decals containing indicia may be attached to the one or both of the main surfaces 20, 22 of the kite. The visual representations add desired decorative and aesthetic effects to the kite 10 for attracting attention, which is particularly advantageous when the kite 10 is used as an advertising or promotional item. The components of the kite 10 as a display or advertising device can also be made from a material which has a finish, such as a fluorescent or luminous finish. Reflective materials or reflective coatings and the like can also be used.

It will be appreciated by those skilled in the art that the kite according to the present invention has a unique structural configuration employing low cost components that can be easily manufactured and assembled with a minimum of effort into a kite that flies easily and in a stable manner. The novel kite configuration results in a high strength-to-weight ratio. The unique construction of the kite according to the present invention also allows the kite to fly in a stable manner even after being subjected to damage of up to 30% to 40% of its structure (e.g., cover sheet, frame assembly, and cord frame).

The kite of the present invention also provides a novel flight stabilization device comprised of the conical-shaped sector portion and the rotational vane which operate to provide sufficient stability for superior flight characteristics at high altitudes and under most meteorological conditions.

From the foregoing description, it can be seen that the present invention comprises an improved kite. It will be appreciated by those skilled in the art that obvious changes can be made to the embodiment described in the foregoing description without departing from the broad inventive concept thereof. It is understood, therefore, that this invention is not limited to the particular embodiment disclosed, but is intended to cover all obvious modifications thereof which are within the scope and the spirit of the invention as defined by the appended claims.

I claim:

1. A kite comprising:

a cover sheet having first and second opposed main surfaces;

a frame assembly attached to the second main surface of the cover sheet to define a body having an overall height and an overall width, the frame assembly having a plurality of frame members connected together to form a generally conical-shaped sector portion defining an air passage through which air flows when the kite is in flight, each of the frame members comprising a first frame member, a second frame member, a third frame member, a fourth frame member, and a fifth frame member, each of the first and second frame members having first and second opposed end portions, the first and second frame members being overlapped at a connecting point with the corresponding first ends being spaced at a first predetermined distance apart and with the corresponding second end portions being spaced at a second predetermined distance apart; and a rotational vane mounted on the frame assembly for undergoing rotation to regulate the flow of air flowing through the air passage when the kite is in flight;

wherein the third frame member has first and second opposite end portions, the third frame member overlapping the first and second frame members at the connecting point and extending outward from the connecting point so that the first end portion of the third frame member is disposed between the second end portion of the first frame member and the first end portion of the second frame member and so that the second end portion of the third frame member is disposed between the first end portion of the first frame member and the second end portion of the second frame member.

2. A kite according to claim 1; wherein the first and second frame members have a length of about 24 inches and the third frame member has a length of about 20 inches.

3. A kite according to claim 1; further comprising a flexible line connected to the connecting point of the first, second, and third frame members and extending through the cover sheet and outward from the first main surface of the cover sheet.

4. A kite according to claim 3; further comprising a flexible tail connected to and extending away from the cover sheet.

5. A kite according to claim 1; wherein the fourth frame member has a first end portion connected to the first, second and third frame members at the connecting point and a second end portion.

6. A kite according to claim 5; wherein the fifth frame member has a first end portion connected to the first end portion of the first frame member and a second end portion connected to the first end portion of the second frame member; and wherein the second end portion of the fourth frame member is connected to a generally central portion of the fifth frame member.

7. A kite according to claim 6; wherein the fifth frame member has a generally curved peripheral edge defining a curved peripheral edge of the conical shaped sector portion of the frame assembly.

8. A kite according to claim 1; further comprising a cord frame connecting the first, second, third, fourth and fifth frame members together to form the frame assembly.

9. A kite according to claim 8; wherein the cord frame comprises a single piece of string.

10. A kite according to claim 8; further comprising mounting means for rotationally mounting the rotational vane on the frame assembly.

11. A kite according to claim 10; wherein the mounting means comprises a portion of the cord frame.

12. A kite according to claim 11; wherein the cord frame comprises a single piece of string.

13. A kite comprising:

a cover sheet having first and second opposed main surfaces;

a frame assembly attached to the second main surface of the cover sheet, the frame assembly having a plurality of frame members connected together to form a generally conical shaped sector portion defining an air passage through which air flows when the kite is in flight, each of the frame members comprising a first frame member, a second frame member, a third frame member, a fourth frame member, and a fifth frame member, each of the first and second frame members having first and second opposed end portions, the first and second frame members being overlapped at a connecting point with the corresponding first ends being spaced at a first predetermined distance apart and with the corresponding second end portions being spaced at a second predetermined distance apart, the third frame member having first and second opposite end portions, the third frame member overlapping the first and second frame members at the connecting point and extending outward from the connecting point so that the first end portion of the third frame member is disposed between the second end portion of the first frame member and the first end portion of the second frame member and so that the second end portion of the third frame member is disposed between the first end portion of the first frame member and the second end portion of the second frame member;

a flexible line connected to the frame and extending through the cover sheet and outward from the first main surface of the cover sheet for controlling the kite during flight; and a flexible tail connected to and extending away from the cover sheet.

14. A kite according to claim 13; further comprising a cord frame connecting the first, second, third, fourth and fifth frame members together to form the frame assembly.

15. An advertising device comprising: a kite comprised of a cover sheet having first and second opposed main surfaces, a frame assembly connected to the second main surface of the cover sheet and having a plurality of frame members connected together to form a generally conical shaped sector portion defining an air passage through which air flows when the kite is in flight, and a rotational vane mounted on the frame assembly for undergoing rotation to regulate the flow of air flowing through the air passage when the kite is in flight; and advertising indicia disposed on at least one of the first and second main surfaces of the cover sheet of the kite; wherein each of the frame members comprises a first frame member, a second frame member, a third frame member, a fourth frame member, and a fifth frame member, each of the first and second frame members having first and second opposed end portions, the first and second frame members being overlapped at a connecting point with the corresponding first ends being spaced at a first predetermined distance apart and with the corresponding second end portions being spaced at a second predetermined distance apart, the third frame member having first and second opposite end portions, the third frame member overlapping the first and second frame members at the connecting point and extending outward from the connecting point so that the first end portion of the third frame member is disposed between the second end portion of the first frame member and the first end portion of the second frame member and so that the second end portion of the third frame member is disposed between the first end portion of the first frame member and the second end portion of the second frame member.

* * * * *